US009178283B1

(12) United States Patent
Obeidat

(10) Patent No.: US 9,178,283 B1
(45) Date of Patent: Nov. 3, 2015

(54) QUAD-SLOT ANTENNA FOR DUAL BAND OPERATION

(71) Applicant: AMAZON TECHNOLOGIES, INC., Reno, NV (US)

(72) Inventor: Khaled Ahmad Obeidat, Santa Clara, CA (US)

(73) Assignee: Amazon Technologies, Inc., Reno, NV (US)

( * ) Notice: Subject to any disclaimer, the term of this patent is extended or adjusted under 35 U.S.C. 154(b) by 460 days.

(21) Appl. No.: 13/621,647

(22) Filed: Sep. 17, 2012

(51) Int. Cl.
*H01Q 13/10* (2006.01)

(52) U.S. Cl.
CPC ..... *H01Q 13/106* (2013.01)

(58) Field of Classification Search
CPC ..... H01Q 13/10
USPC ..... 343/770, 767, 776
See application file for complete search history.

(56) References Cited

U.S. PATENT DOCUMENTS

| | | | | |
|---|---|---|---|---|
| 7,719,470 | B2 * | 5/2010 | Wang et al. | 343/700 MS |
| 8,648,752 | B2 * | 2/2014 | Ramachandran et al. | 343/702 |
| 2005/0237251 | A1 * | 10/2005 | Boyle et al. | 343/770 |
| 2008/0231532 | A1 * | 9/2008 | Rao et al. | 343/770 |
| 2009/0295646 | A1 * | 12/2009 | Oh et al. | 343/702 |
| 2011/0012790 | A1 * | 1/2011 | Badaruzzaman et al. | 343/700 MS |
| 2013/0082884 | A1 * | 4/2013 | Gummalla | 343/702 |

* cited by examiner

*Primary Examiner* — Huedung Mancuso
(74) *Attorney, Agent, or Firm* — Lowenstein Sandler LLP

(57) ABSTRACT

Quad-slot antenna structures of user devices and methods of operating the user devices with the quad-slot antenna structures are described. One apparatus includes a RF feed coupled to a quad-slot antenna, including a first slot and a second slot and a third slot and a fourth slot. The first slot and the second slot are driven elements and the third slot and the fourth slot are parasitic elements.

17 Claims, 10 Drawing Sheets

QUAD-SLOT ANTENNA FOR DUAL BAND OPERATION

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high band. One resonant mode in the lower frequency band and one resonant mode in the high band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union. Application services include wide-area wireless voice telephone, mobile Internet access, video calls and mobile TV, all in a mobile environment. The required frequency bands for 3G applications may be GSM850/EGSM in low band and DCS/PCS/WCDMA in high band. The 3G band is between 824 MHz and 960 MHz. Long Term Evolution (LTE) and LTE Advanced standards (sometimes generally referred to as 4G) are communication standards that have been standardized by the 3rd Generation Partnership Project (3GPP). However, in order to extend the frequency coverage down to 700 MHz for 4G/LTE application, antenna bandwidth needs to be increased especially in the low band. There are two common LTE bands used in the United States from 704 MHz-746 MHz (Band 17) and from 746 MHz-787 MHz (Band 13). Conventional solutions increase the antenna size or use active tuning elements to extend the bandwidth. Alternatively, conventional solutions use separate antennas to achieve different frequency bands and use a switch to switch between the antennas. These solutions are not conducive to use in user devices, often because of the size of the available space for antennas within the device.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
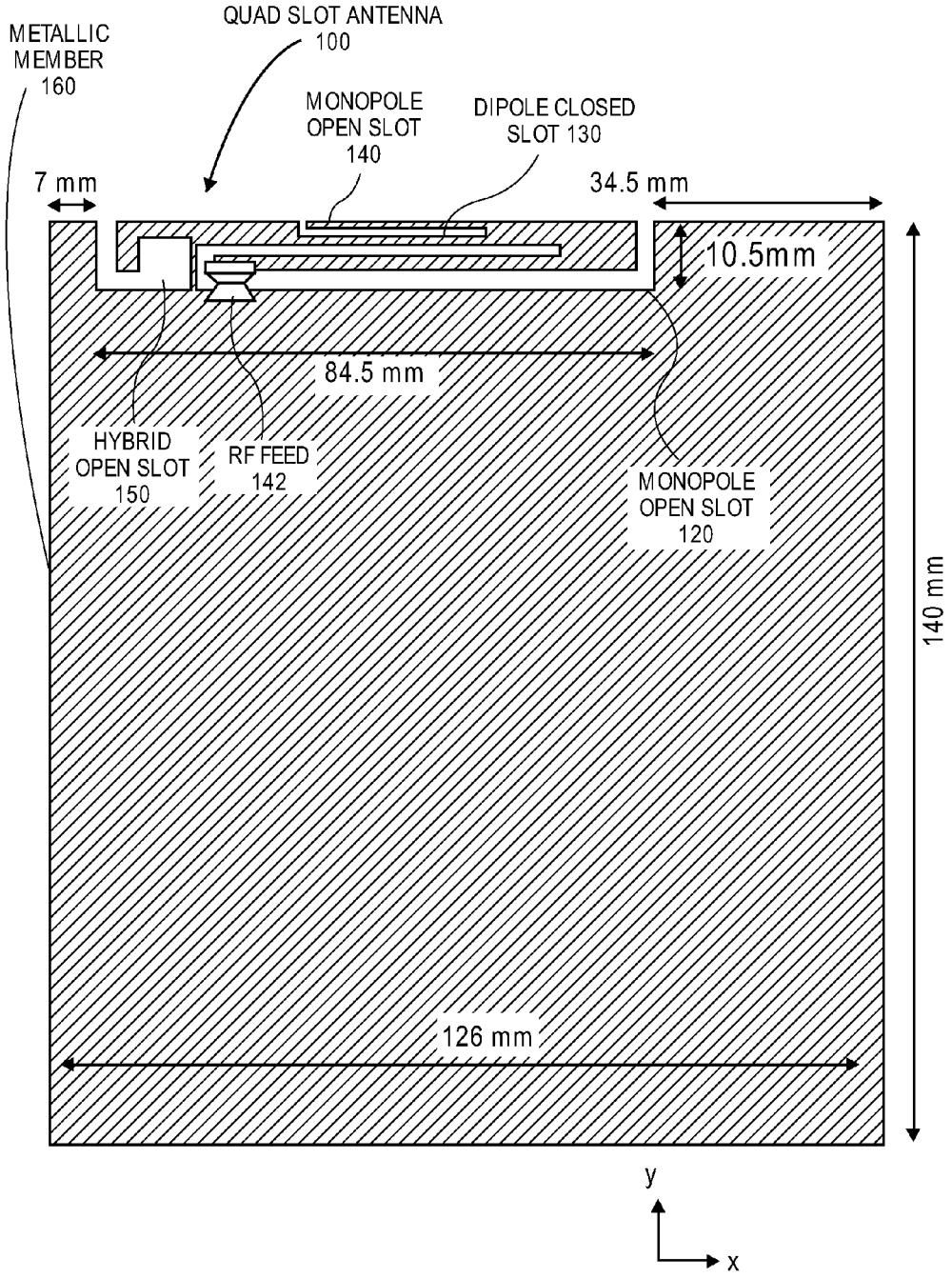
FIG. 1 illustrates one embodiment of a quad-slot antenna coupled to a radio frequency (RF) feed.

Quad-slot antenna structures of user devices and methods of operating the user devices with the quad-slot antenna structures are described. One apparatus includes a RF feed coupled to a quad-slot antenna, including a first slot and a second slot and a third slot and a fourth slot. The first slot and the second slot are driven elements and the third slot and the fourth slot are parasitic elements. The first slot and the second slot are configured to operate as feeding structures to the third and fourth slots that are not conductively connected to the RF feed. The antenna structure has an RF feed that drives the first slot and the second slot as active or driven elements and the third slot and the fourth slot are parasitic elements that are fed by the first and second slots. By parasitically coupling the first and second slots and the third and fourth slots, multiple resonant modes can be created in a low band and in a high band of a desired frequency range, such as 824 MHz to 960 MHz in a low band and 1.71 GHz to 2.17 GHz in a high band. A parasitic element is an element of the quad-slot antenna structure 100 that is not driven directly by the single RF feed 142. Rather, the single RF feed 142 directly drives the first monopole open slot 120 and the dipole closed slot 130, which parasitically induce a current on the parasitic elements, namely the hybrid open slot 140 and the second monopole open slot 150. In particular, by directly inducing current on the first monopole open slot 120 and the dipole closed slot 130 by the single RF feed 142, the directly-fed structures radiates electromagnetic energy, which causes another current on the hybrid open slot 140 and the second monopole open slot 150 to also radiate electromagnetic energy, creating multiple resonant modes. In the depicted embodiment, the hybrid open slot 140 and the second monopole open slot 150 are parasitic because these elements are physically separated from the first monopole open slot 120 and the dipole closed slot 130, which are driven at the single RF feed 142. It can also be said that the second monopole open slot 130 and the second monopole open slot 150 are not conductively connected to the RF feed 142. The driven first monopole open slot 120 and driven dipole closed slot 130 parasitically excite the current flow of the hybrid open slot 140 and the second monopole open slot 150. In one embodiment, the hybrid open slot 140 and the second monopole open slot 150 can be physically separated by one or more gaps between the first monopole open slot 120 and the dipole closed slot 130. Alternatively, other antenna configurations may be used to include driven antenna elements and parasitic grounding elements.

The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

As described above, the conventional antenna usually has only one resonant mode in the lower frequency band and one resonant mode in the high band. The embodiments described herein extend the bandwidth by using the quad-slot antenna structures described herein. In one embodiment, one of the antenna structures is configured to operate between 700 MHz and 960 MHz in a low band and between 1.71 and 2.17 GHz in a high band. In other embodiments, the antenna structure is configured to operating in one or more of the following frequency bands Long Term Evolution (LTE) 700, LTE 2700, Universal Mobile Telecommunications System (UMTS) and Global System for Mobile Communications (GSM) 850, GSM 900, GSM 1800 and GSM 1900. The antenna structure may provide multiple resonant modes, for example, the first slot provides a first resonant mode, the second slot provides a second resonant mode, the third slot provides a third resonant mode, and the fourth slot provides a fourth resonant mode. The fourth resonant mode can be tuned for the lower band or for the high band as described herein.

The embodiments described herein are not limited to use in 3G and LTE bands, but could be used to increase the bandwidth of a multi-band frequency in other bands, such as Dual-band Wi-Fi, GPS, cellular, and Bluetooth frequency bands as described herein. The embodiments described herein provide an antenna structure to be coupled to a single RF feed and does not use any active tuning to achieve the extended bandwidths. The embodiments described herein also provide an antenna structure with a size that is conducive to being used in a user device.

FIG. 1 illustrates one embodiment of a quad-slot antenna 100 coupled to a radio frequency (RF) feed 142. The quad-slot antenna 100 is formed in the material of a metallic member 160. In one embodiment, the metallic member 160 is a ground plane of a circuit board as depicted in FIG. 1. The ground plane may be a system ground or one of multiple grounds of the user device. Alternatively, the metallic member 160 may be a metallic support member of a display, a touchpad, or a touchscreen of the user device, a metallic housing, a metallic portion of a non-metallic housing, a metallic bezel, a metallic support member of a circuit board, such as a printed circuit board (PCB), or metallic support members of other existing components, such as keyboards, buttons, displays, circuits, or the like. This metal member may also be non-structural, such as a metal member that is used for decorative or aesthetic purposes.

The quad-slot antenna 100 includes a first monopole open slot 120 conductively connected to the RF feed 142, a dipole closed slot 130 conductively connected to the RF feed 142, a hybrid open slot 140 that is not conductively connected to the RF feed 142, and a second monopole open slot 150 that is not conductively connected to the RF feed 142. In one embodiment, the hybrid open slot 140 is configured to radiate electromagnetic energy as a monopole open slot in a first configuration and as an L-shape monopole in a second configuration as described herein. For example, a length of the hybrid open slot 140 can be tuned to a first length so that the hybrid open slot 140 is configured to operate as the monopole open slot. The length can be tuned to a second length so that the hybrid open slot 140 is configured to operate as the L-shape monopole.

In one embodiment, the first monopole open slot 120 is configured to radiate electromagnetic energy in a first resonant mode in a low band of a standard wireless frequency band, such as the $3^{rd}$ generation (3G) wireless frequency band standardized by the 3rd Generation Partnership Project (3GPP), the dipole closed slot 130 and the second monopole open slot 150 are configured to radiate electromagnetic energy in second and fourth resonant modes in a high band of the standard wireless frequency band. In one embodiment, the hybrid open slot 140 is configured to radiate electromagnetic energy in a third resonant mode in the high band of the standard wireless frequency band. In another embodiment, the hybrid open slot 140 is configured to radiate electromagnetic energy in a third resonant mode in the low band of the standard wireless frequency band. Alternatively, other standard wireless frequency bands may be covered by the quad-slot antenna 100 as would be appreciated by one of ordinary skill in the art having the benefit of this disclosure.

In the depicted embodiment, the first monopole open slot 120 extends in a first direction from the RF feed towards a first side of the metallic member 160 until a first bend and extends from the first bend to a second side of the metallic member 160 to form a first open slot opening at the second side of the metallic member 160. The dipole closed slot 130 extends from the RF feed 142 toward the second side until a second bend and extends from the second bend in the first direction substantially parallel to the first slot and stops to form a closed slot opening in the metallic member 160. The hybrid open slot 140 extends from a second slot opening at the second side of the metallic member 160 towards the second slot until a third bend and extends from the third bend in the first direction substantially parallel to the second slot. In one embodiment, the second monopole open slot 150 extends from a third slot opening at the second side of the metallic member 160 until a fourth bend and extends from the fourth bend towards the RF feed 142 in the first direction until a fifth bend and extends from the fifth bend towards the second side of the metallic member 160.

In one embodiment, an effective width of the quad-slot antenna 100 is 84.5 millimeters (mm) and an effective height of the quad-slot antenna is 10.5 mm. The metallic member 160 may be 126 mm with 34.5 mm between the first side and the first slot opening on the second side and 7 mm between the third slot opening and a third side that is opposite of the first side. In the depicted embodiment, the metallic member 160 is 140 mm in height and 126 mm in width. Alternatively, other dimensions may be used for the quad-slot antenna 100, as well as the metallic member 160 and the distances between the quad-slot antenna 100 and the sides of the metallic member 160. For example, as described herein, the length of the second monopole open slot 150 can be extended to extend the coverage of the low band, instead of covering the high band. It should be noted that the dimensions of the quad-slot antenna structure 100 may be varied to achieve the desired frequency range as would be appreciated by one of ordinary skill in the art having the benefit of this disclosure, however, the total lengths of the antenna elements are a major factor for determining the frequency, and the widths of the antenna elements are a factor for impedance matching. It should be noted that the factors of total length and width are dependent on one another.

In FIG. 1, the metallic member 160 operates as a radiation ground plane. The RF feed 142 may be a feed line connector that couples the quad-slot antenna structure 100 to a feed line (also referred to as the transmission line), which is a physical connection that carriers the RF signal to and/or from the quad-slot antenna structure 100. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to first monopole open slot 120 and the dipole closed slot 130 of the quad-slot antenna structure 100, but is not conductively connected to the hybrid open slot 140 and the second monopole open slot 150 of the quad-slot antenna structure 100. However, the first monopole open slot 120 and the dipole closed slot 130 are configured to operate as feeding structures to the hybrid open slot 140 and the second monopole open slot 150.

In another embodiment, slot openings of the quad-slot antenna structure 100 may be disposed on or within a circuit board, such as a printed circuit board (PCB). Alternatively, the quad-slot antenna structure 100 may be disposed on other components of the user device or within the user device as would be appreciated by one of ordinary skill in the art having the benefit of this disclosure. It should be noted that the quad-slot antenna structure 100 illustrated in FIG. 1 is a two-dimensional (3D) structure. However, as described herein, the quad-slot antenna structure 100 may be three-dimensional (3D), as well as other variations than those depicted in FIG. 1.

The quad-slot antenna structure 100 is configured to provide multiple resonant modes. In one embodiment, the quad-slot antenna structure 100 is configured to radiate electromagnetic energy in a first mode (low band) LB1, a second mode (high band) HB1, a third mode (high band) HB2, a fourth mode (high band) HB3). In another embodiment, the quad-slot antenna structure 100 is configured to radiate electromagnetic energy in a first mode (low band) LB1, a second mode (high band) HB1, a third mode (high band) HB2, a fourth mode (low band) LB2). In the depicted embodiment, the quad-slot antenna structure 100 is configured to operate between 824 MHz and 960 MHz in a low band and between 1.71 and 2.1 GHz in a high band. This allows the quad-slot antenna structure 100 to operate in one or more of the following frequency bands: LTE 700, LTE 2700, UMTS, GSM 850, GSM 900, GSM 1800 and GSM 1900. In a further embodiment, the quad-slot antenna structure 100 is configured to operate in additional frequency bands, such as Global Positioning System (GPS), wireless local area network (WLAN) (e.g., WiFi), personal area network (PAN), or any combination thereof. Using the first monopole open slot 120, the dipole closed slot 130, and the hybrid open slot 140, the quad-slot antenna structure 100 can create multiple resonant modes using the single RF feed 142, such as three or more resonant modes. In one embodiment, the first monopole open slot 120 is configured to radiate electromagnetic energy in a low-band frequency range between 800 MHz and 960 MHz, and the dipole closed slot 130, the hybrid open slot 140, and second monopole open slot 150 are configured to radiate electromagnetic energy in a high-band frequency range between 1.71 GHz and 2.1 GHz. In another embodiment, the first monopole open slot 120 and the hybrid open slot 140 are configured to radiate electromagnetic energy in a low-band frequency range between 800 MHz and 960 MHz, and the dipole closed slot 130 and the second monopole open slot 150 are configured to radiate electromagnetic energy in a high-band frequency range between 1.71 GHz and 2.1 GHz. In another embodiment, the quad-slot antenna structure 100 can be configured to create a resonant mode for LTE 700 plus resonant modes for penta-band. In telecommunications, the terms multi-band, dual-band, tri-band, quad-band, and penta-band refer to a device, such as the user device described herein, supporting multiple RF bands used for communication. In other embodiments, the antennas can be designed to cover multiple bands, including LTE/GSM/UMTS, the GSM850/900/1800/1900/UMTS penta-band operation, or the LTE700/GSM850/900 (698-960 MHz) and GSM 1800/190/UMTS/LTE2300/2500 (1710-2690) MHz operation. In the user device context, the purpose of doing so is to support roaming between different regions whose infrastructure cannot support mobile services in the same frequency range. These frequency bands may be UMTS frequency bands, GSM frequency bands, or other frequency bands used in different communication technologies, such as, for example, cellular digital packet data (CDPD), general packet radio service (GPRS), enhanced data rates for GSM evolution (EDGE), 1 times radio transmission technology (1xRTT), evaluation data optimized (EVDO), high-speed downlink packet access (HSDPA), WiFi, WiMax, etc.

Figure 2:
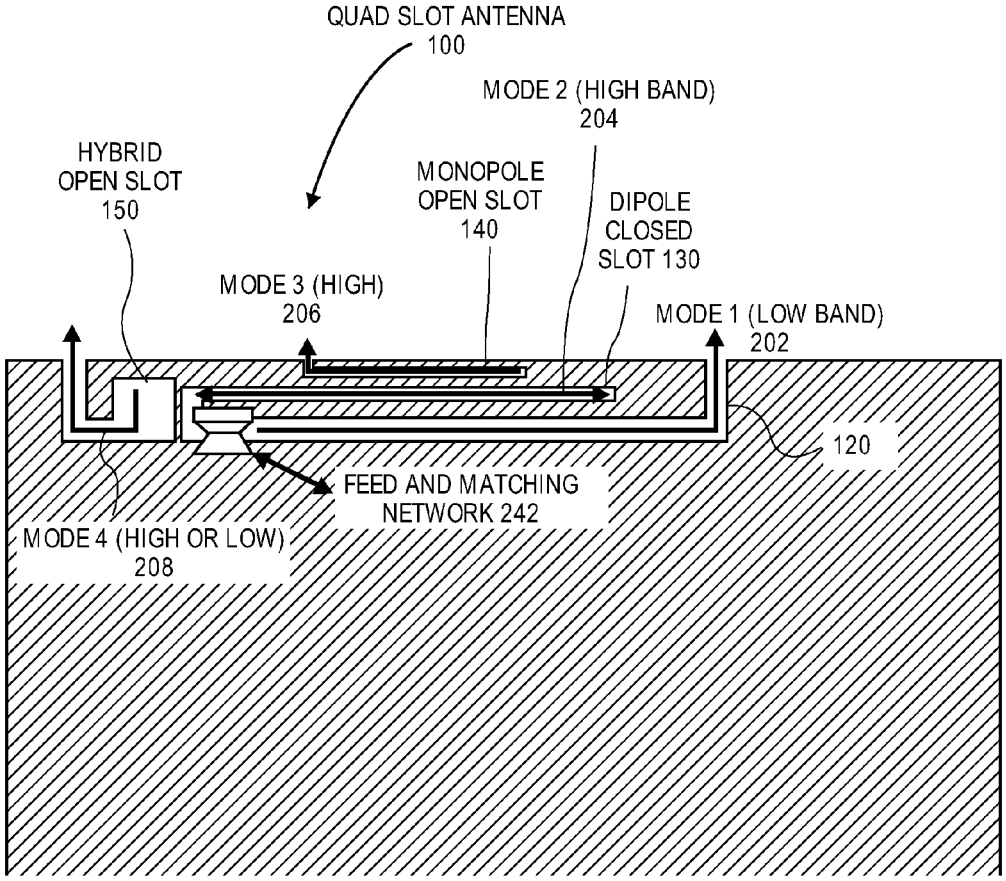
FIG. 2 illustrates current flow for the four resonant modes of the quad-slot antenna of FIG. 1 according to one embodiment.

FIG. 2 illustrates current flow for the four resonant modes of the quad-slot antenna of FIG. 1 according to one embodiment. In this embodiment, the first monopole open slot 120 is configured to operate in a first mode 202 (low band). The dipole closed slot 130 is configured to operate in a second mode 202 (high band). The hybrid open slot 140 is configured to operate in a third mode 206 (high band or low band). The second monopole open slot 150 is configured to operate in a fourth mode 208 (high band).

Figure 3:
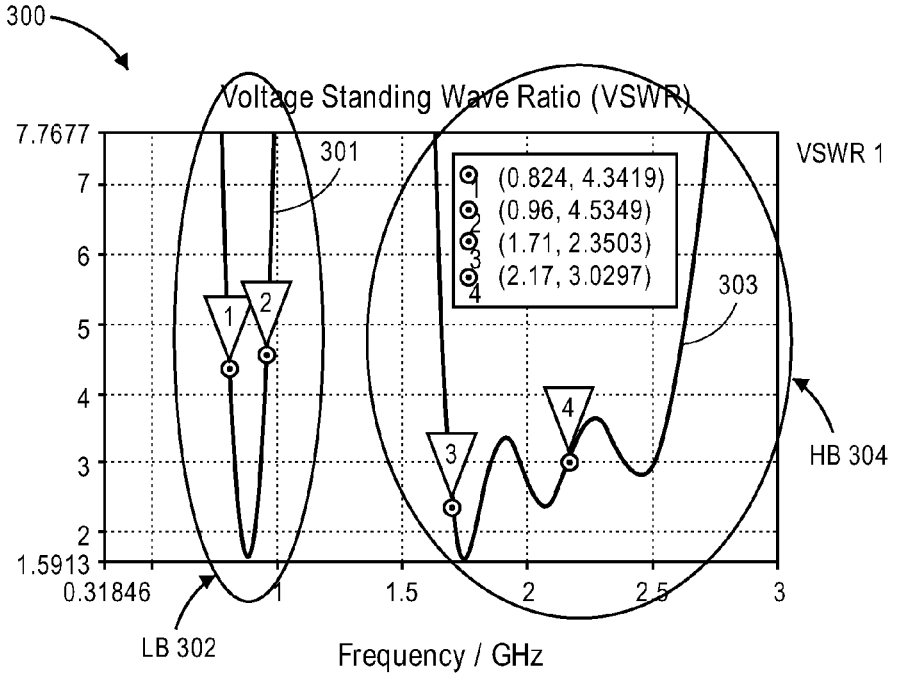
FIG. 3 is a graph of the voltage standing wave ratio (VSWR) of a quad-slot antenna when the hybrid open slot is tuned for the low band according to one embodiment.

FIG. 3 is a graph 300 of the voltage standing wave ratio (VSWR) of a quad-slot antenna when the hybrid open slot is tuned for the low band according to one embodiment. VWSR is used as an efficiency measure for transmission lines for RF signals. A problem with transmission lines is that impedance mismatches in the line tend to reflect the radio waves back toward the source, preventing all the power from reaching the destination end. The voltage component of a standing wave in a uniform transmission line includes the forward wave superimposed on the reflected wave. The reflection coefficient is defined as the reflected wave over the forward wave. SWR is the ratio of the voltage amplitude of a partial standing wave at an antinode (maximum) to the amplitude at an adjacent node (minimum) in an electrical transmission line. The graph 300 illustrates VSWR 301 in a low band 302 and VSWR 303 in a high band 304. In this embodiment, there is a first resonant mode in the low band 302 and three resonant modes in the high band 304. The first resonant mode covers a frequency range of about 800 MHz to 960 MHz, and the three resonant modes cover a frequency range of about 1.71 GHz to 2.6 GHz. The markers on the VSWR 301 and VSWR 303 identify the VSWR at the different frequencies in the low band 301 and the high band 303.

Figure 4:
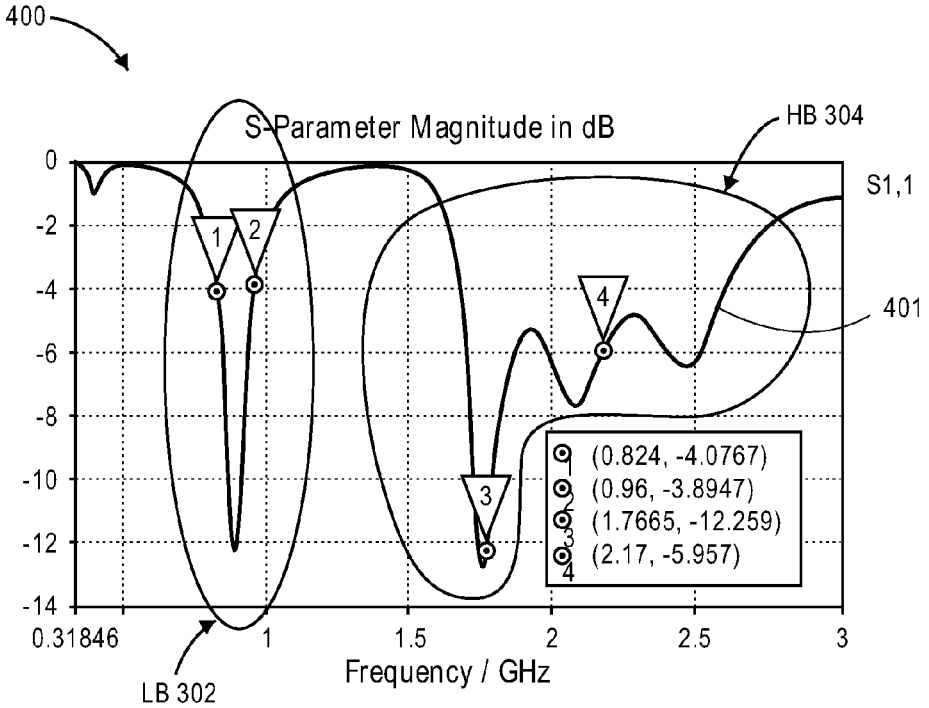
FIG. 4 is a graph of the reflection coefficient of the quad-slot antenna when the hybrid open slot is tuned for the low band according to one embodiment.

FIG. 4 is a graph 400 of the reflection coefficient of the quad-slot antenna when the hybrid open slot is tuned for the low band according to one embodiment. The graph 400 shows the measured reflection coefficient (also referred to S-parameter or |S11|) 401 of the quad-slot antenna structure 100 of FIG. 1. The quad-slot antenna structure 100 covers approximately 800 MHz to 960 MHz in the low band 302 and 1.71 GHz to 2.1 GHz in the high band 304. The quad-slot antenna structure 100 provides four resonant modes, including one in the low band 302 and three in the high band. The resonant mode in the low band 302 covers the frequency range 800 MHz to 960 MHz. The three resonant modes in the high band 304 include a resonant mode centered at 1.7 GHz, a resonant mode centered at 2.1 GHz, and a resonant mode centered at 2.4 GHz. As described herein, other resonant modes may be achieved.

In other embodiments, more or less than four resonant modes may be achieved as would be appreciated by one of ordinary skill in the art having the benefit of this disclosure. It should also be noted that the first, second, third, fourth and fifth notations on the resonant modes are not be strictly interpreted to being assigned to a particular frequency, frequency range, or elements of the antenna structure. Rather, the first, second, third, fourth and fifth notations are used for ease of description. However, in some instances, the first, second, third fourth and fifth are used to designate the order from lowest to highest frequencies. Alternatively, other orders may be achieved as would be appreciated by one of ordinary skill in the art having the benefit of this disclosure. In one embodiment, the quad-slot antenna structure 100 can be configured for the LTE (700/2700), UMTS, GSM (850, 800, 1800 and 1900), GPS and Wi-FI/Bluetooth frequency bands. In another embodiment, the quad-slot antenna structure 100 can be designed to operate in the following target bands: 1) Verizon LTE band: 746 to 787 MHz; 2) US GSM 850: 824 to 894 MHz; 3) GSM900: 880 to 960 MHz; 4) GSM 1800/DCS: 1.71 to 1.88 GHz; 5) US1900/PCS (band 2): 1.85 to 1.99 GHz; and 6) WCDMA band I (band 1): 1.92 to 2.17 GHz. These resonance bandwidths may be characterized by VNA measurements with about 6 dB bandwidth (BW). Alternatively, the quad-slot antenna structure 100 can be designed to operate in different combinations of frequency bands as would be appreciated by one of ordinary skill in the art having the benefit of this disclosure. Alternatively, the quad-slot antenna structure 100 can be configured to be tuned to other frequency bands as would be appreciated by one of ordinary skill in the art having the benefit of this disclosure.

Figure 5:
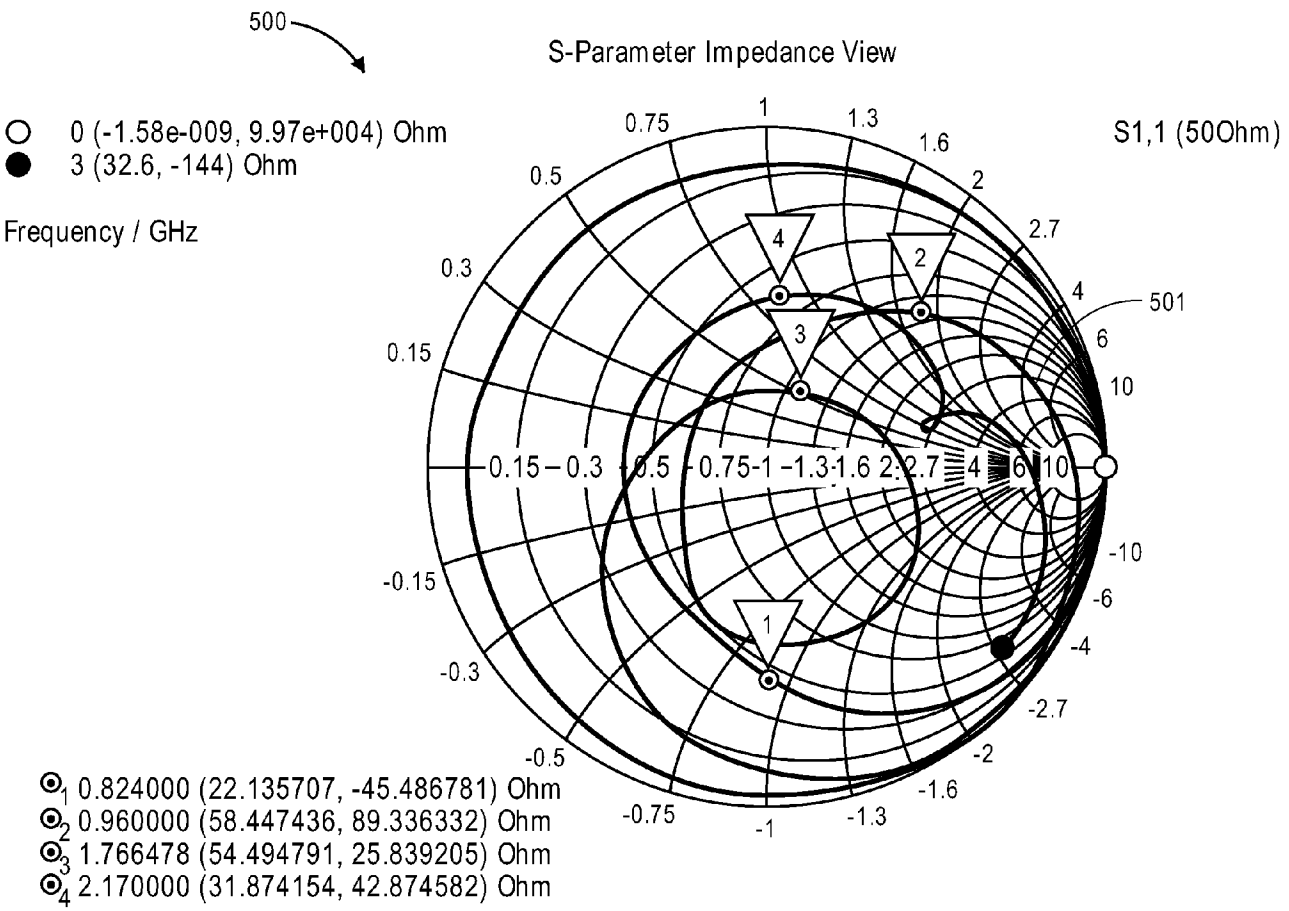
FIG. 5 is a Smith chart of an input impedance of the quad-slot antenna when the hybrid open slot is tuned for the low band according to one embodiment.

FIG. 5 is a Smith chart 500 of an input impedance of the quad-slot antenna when the hybrid open slot is tuned for the low band according to one embodiment. FIG. 5 is a Smith chart 500 of an input impedance of the quad-slot antenna 100 of FIG. 1 according to one embodiment. The Smith chart 500 illustrates how the impedance and reactance behave at one or more frequencies for the quad-slot antenna 100 with the hybrid open slot 140 tuned to the low band 302. In particular, the line 501 corresponds to the impedance of the quad-slot antenna 100. The Smith chart 500 illustrates the quad-slot antenna 100 as having three resonant modes in the high band 304 as the locus of antenna input impedance on the Smith chart 500 as identified as two loops. The Smith chart 500 also illustrates the quad-slot antenna 100 as having a resonant mode at the LB 302 as identified as one loop.

Figure 6:
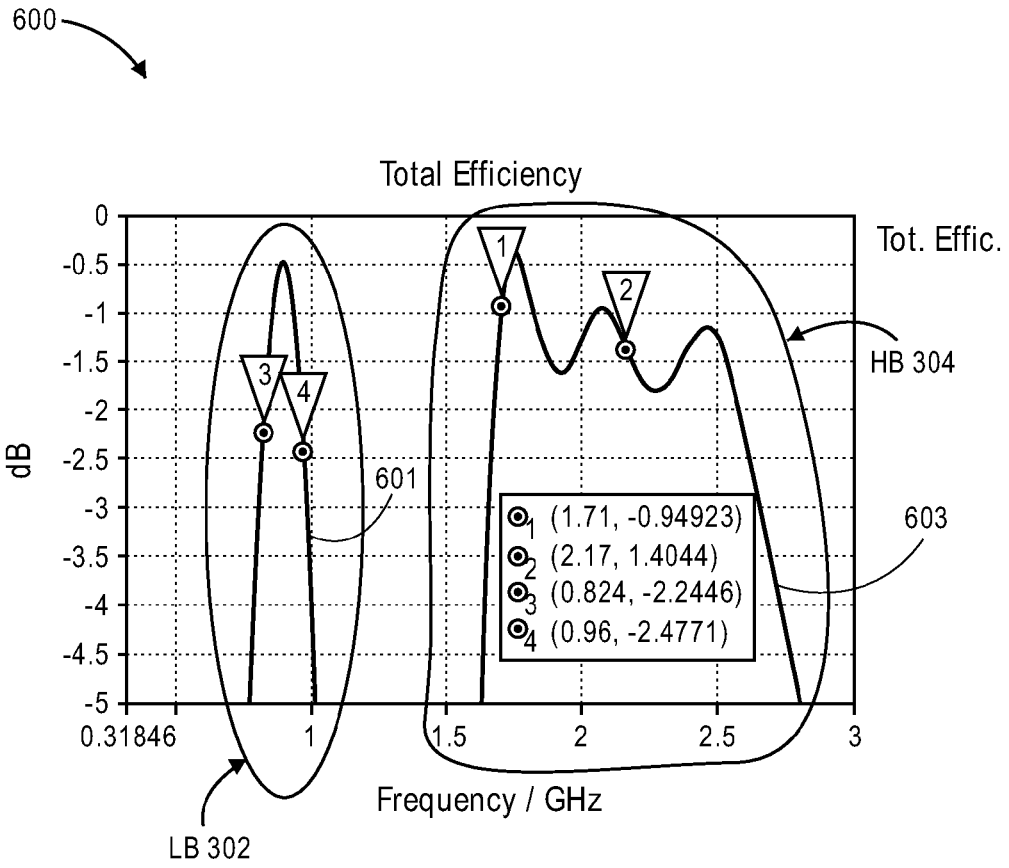
FIG. 6 is a graph of efficiencies of the quad-slot antenna when the hybrid open slot is tuned for the low band according to one embodiment.

FIG. 6 is a graph 600 of efficiencies of the quad-slot antenna when the hybrid open slot is tuned for the low band according to one embodiment. The graph 600 illustrates the total efficiency 601 over a frequency range in the low band 302 and the total efficiency 603 over a frequency range in the high band 304. The graph 600 illustrates that the quad-slot antenna structure 100 is a viable antenna for the frequency range in a low-band between 824 MHz and 960 MHz, and in a high-band between 1.7 GHz and 2.5 GHz.

As would be appreciated by one of ordinary skill in the art having the benefit of this disclosure, the total efficiency of the antenna can be measured by including the loss of the structure and mismatch loss. The efficiency of the antenna can be tuned for specified target bands. For example, the target band can be Verizon LTE band and the GSM850/900 band, and the quad-slot antenna structure 100 can be tuned to optimize the efficiency for this band as well as for other bands, such as DCS, PCS and WCDMA bands. The efficiency of the antenna structure may be optimized by adjusting dimensions of the 2D structure, the gaps between the elements of the structure, a distance between the RF feed 142 and the grounding points at the ground plane, or any combination thereof. Similarly, 3D structures can be modified in dimensions and gaps between elements to improve the efficiency in certain frequency bands as would be appreciated by one of ordinary skill in the art having the benefit of this disclosure. It should also be noted that the antennas described herein may be implemented with two-dimensional geometries, as well as three-dimensional geometries as described herein.

Figure 7:
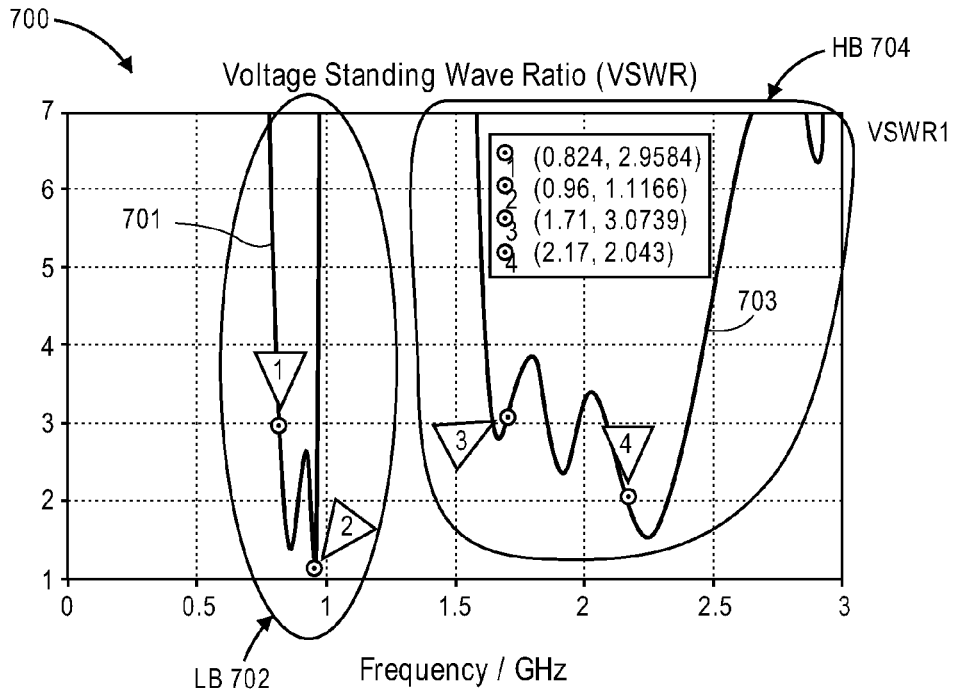
FIG. 7 is a graph of the VSWR of a quad-slot antenna when the hybrid open slot is tuned for the high band according to one embodiment.

FIG. 7 is a graph 700 of the VSWR of a quad-slot antenna when the hybrid open slot is tuned for the high band according to one embodiment. The graph 700 illustrates VSWR 701 in a low band 702 and VSWR 703 in a high band 704. In this embodiment, there are two resonant modes in the low band 702 and three resonant modes in the high band 704. The two resonant modes in the low band 702 cover a frequency range of about 800 MHz to 960 MHz, and the three resonant modes cover a frequency range of about 1.71 GHz to 2.17 GHz.

Figure 8:
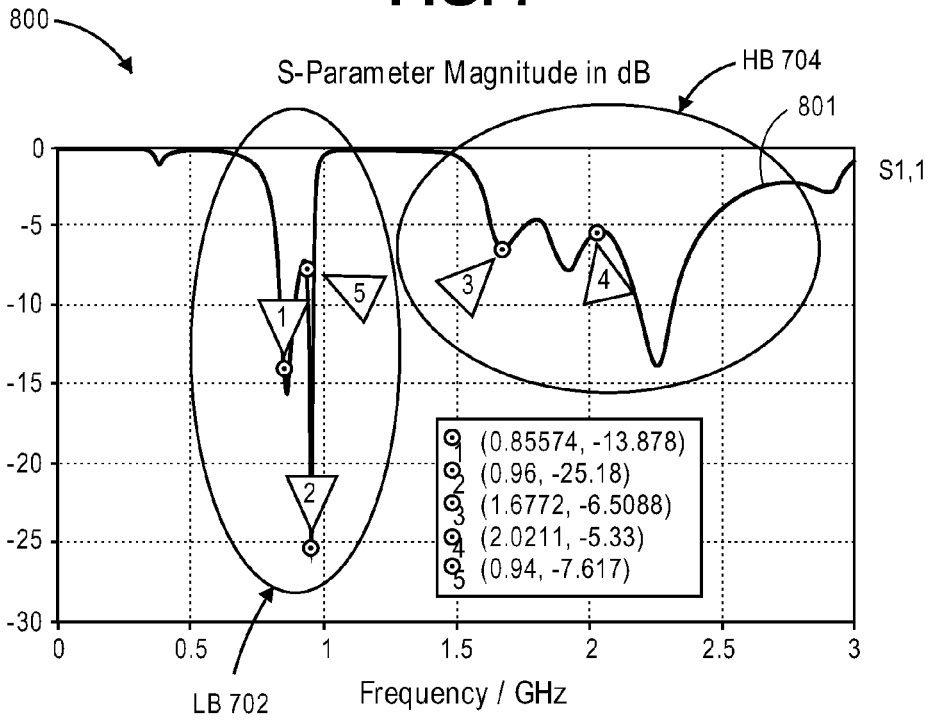
FIG. 8 is a graph of the reflection coefficient of the quad-slot antenna when the hybrid open slot is tuned for the high band according to one embodiment.

FIG. 8 is a graph of the reflection coefficient of the quad-slot antenna when the hybrid open slot is tuned for the high band according to one embodiment. The graph 800 shows the measured reflection coefficient (also referred to S-parameter or |S11|) 801 of the quad-slot antenna structure 100 of FIG. 1 with the hybrid open slot 140 tuned to the high band 304. The quad-slot antenna structure 100 covers approximately 800 MHz to 960 MHz in the low band 302 and 1.71 GHz to 2.1 GHz in the high band 304. The quad-slot antenna structure 100 provides five resonant modes, including two in the low band 702 and three in the high band 704. The resonant modes in the low band 702 cover the frequency range 800 MHz to 960 MHz. The three resonant modes in the high band 704 include a resonant mode centered at 1.7 GHz, a resonant mode centered at 1.9 GHz, and a resonant mode centered at 2.3 GHz. As described herein, other resonant modes may be achieved.

Figure 9:
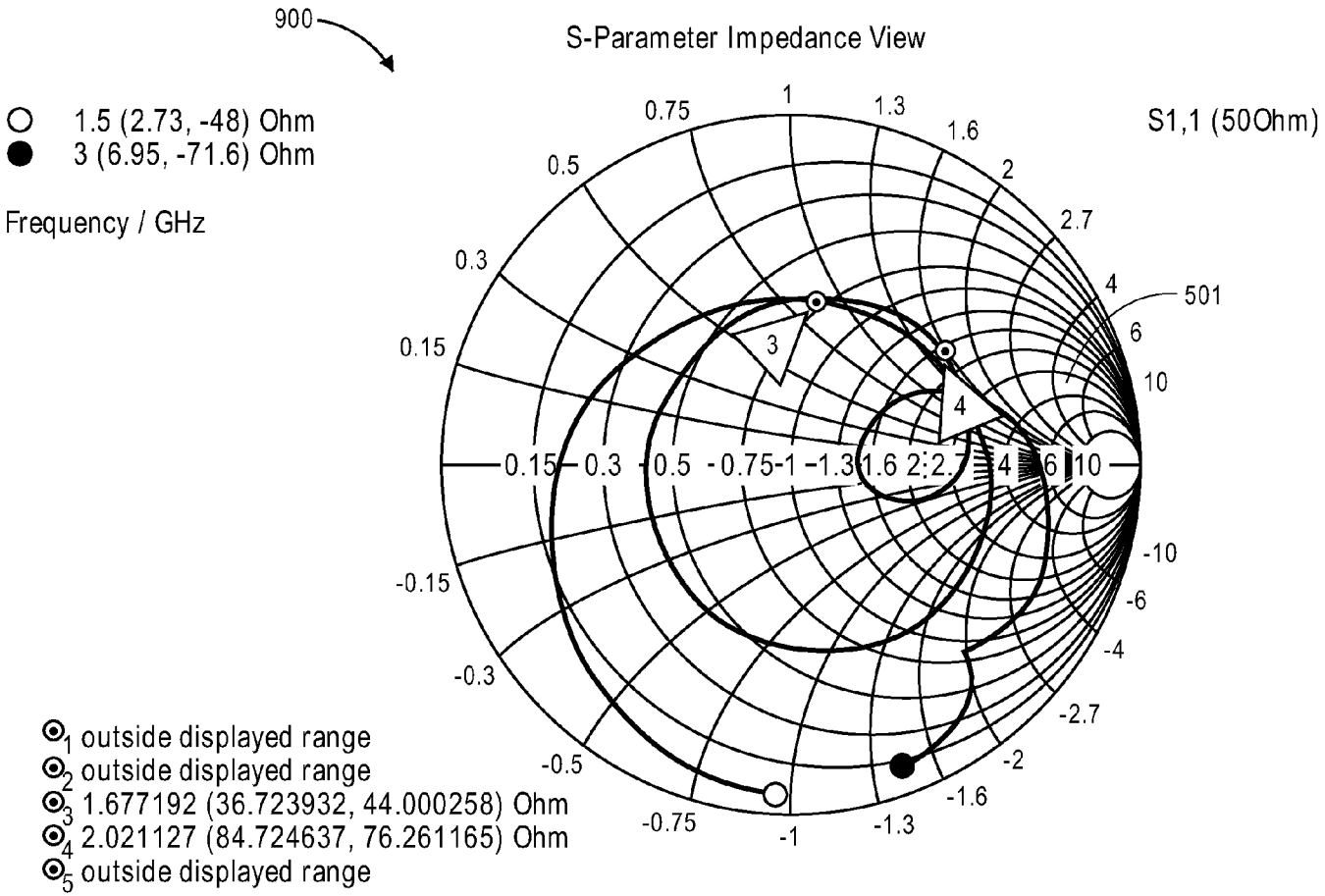
FIG. 9 is a Smith chart of an input impedance of the quad-slot antenna when the hybrid open slot is tuned for the high band according to one embodiment.

FIG. 9 is a Smith chart 900 of an input impedance of the quad-slot antenna when the hybrid open slot is tuned for the high band according to one embodiment. FIG. 9 is a Smith chart 900 of an input impedance of the quad-slot antenna 100 of FIG. 1 according to one embodiment. The Smith chart 900 illustrates how the impedance and reactance behave at one or more frequencies for the quad-slot antenna 100 with the hybrid open slot 140 tuned to the high band 304. In particular, the line 901 corresponds to the impedance of the quad-slot antenna 100. The Smith chart 900 illustrates the quad-slot antenna 100 as having three resonant modes in the high band 704 as the locus of antenna input impedance on the Smith chart 900 as identified as two loops. The Smith chart 900 also illustrates the quad-slot antenna 100 as having two resonant modes at the LB 702.

Figure 10:
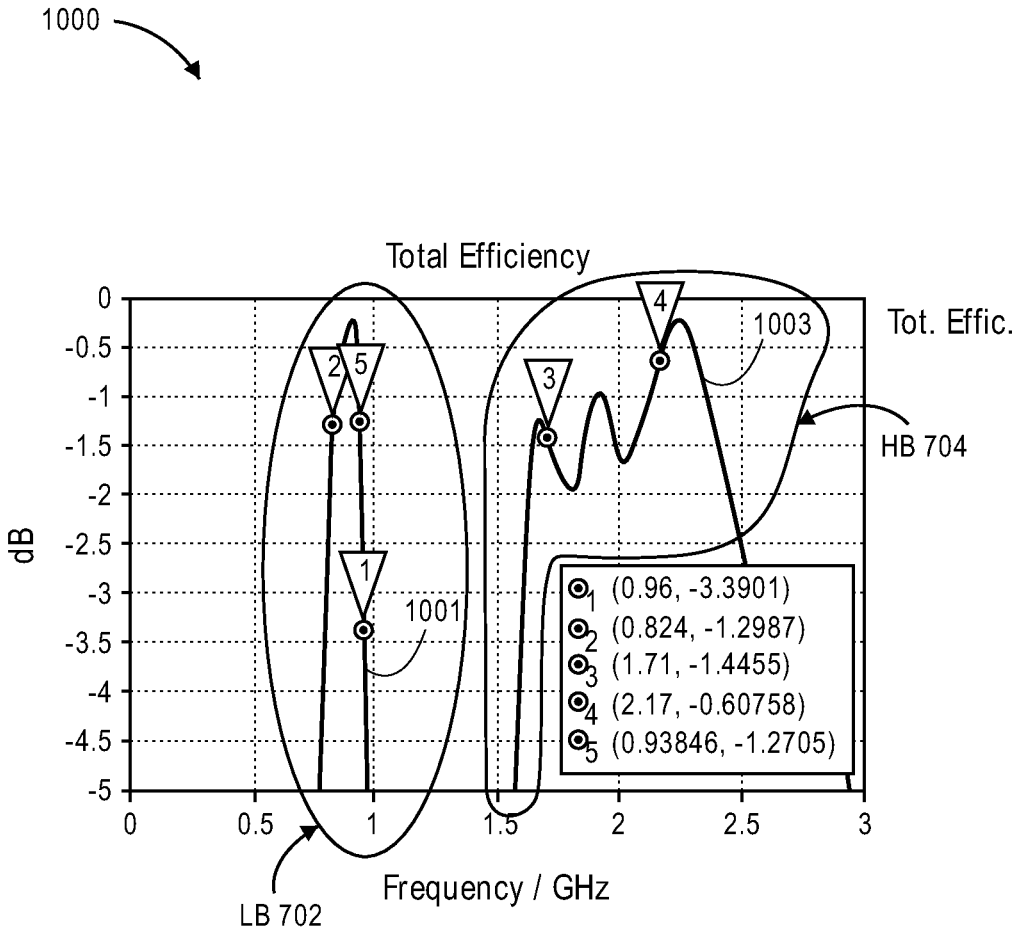
FIG. 10 is a graph of efficiencies of the quad-slot antenna when the hybrid open slot is tuned for the high band according to one embodiment.

FIG. 10 is a graph 1000 of efficiencies of the quad-slot antenna when the hybrid open slot is tuned for the high band according to one embodiment. The graph 1000 illustrates the total efficiency 1001 over a frequency range in the low band 702 and the total efficiency 1003 over a frequency range in the high band 704. The graph 1000 illustrates that the quad-slot antenna structure 100 is a viable antenna for the frequency range in a low-band between 824 MHz and 960 MHz, and in a high-band between 1.7 GHz and 2.5 GHz.

Figure 11:
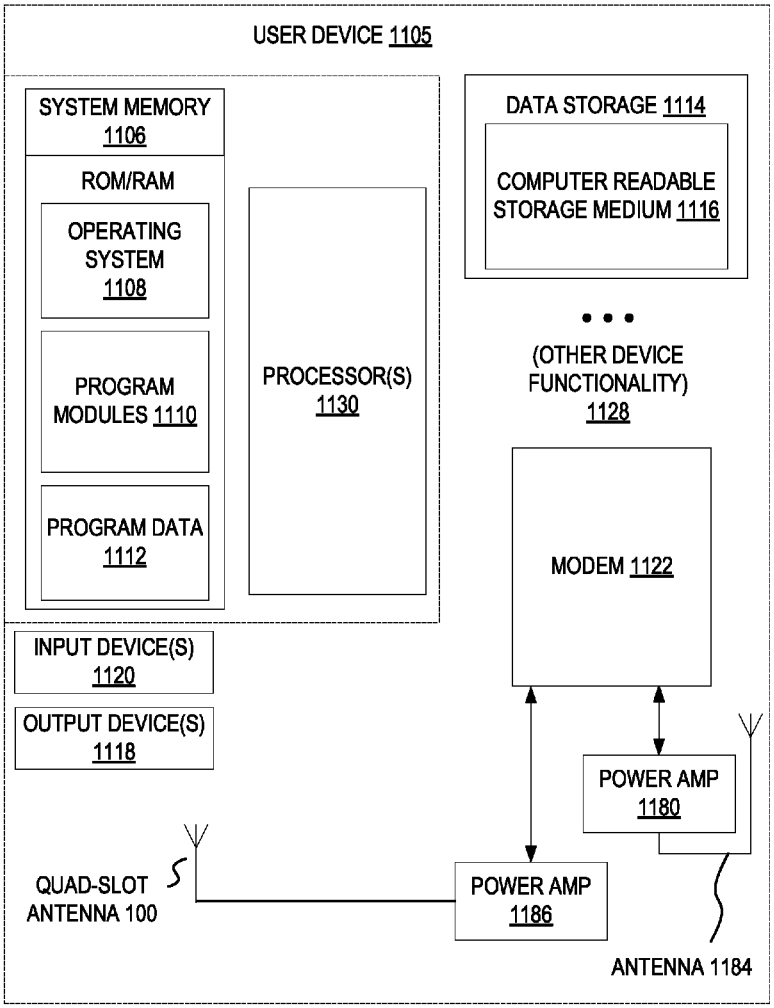
FIG. 11 is a block diagram of a user device having a quad-slot antenna according to one embodiment.

FIG. 11 is a block diagram of a user device having a quad-slot antenna 100 according to one embodiment. The user device 1105 includes one or more processors 1130, such as one or more CPUs, microcontrollers, field programmable gate arrays, or other types of processing devices. The user device 1105 also includes system memory 1106, which may correspond to any combination of volatile and/or non-volatile storage mechanisms. The system memory 1106 stores information, which provides an operating system component 1108, various program modules 1110, program data 1112, and/or other components. The user device 1105 performs functions by using the processor(s) 1130 to execute instructions provided by the system memory 1106.

The user device 1105 also includes a data storage device 1114 that may be composed of one or more types of removable storage and/or one or more types of non-removable storage. The data storage device 1114 includes a computer-readable storage medium 1116 on which is stored one or more sets of instructions embodying any one or more of the functions of the user device 1105, as described herein. As shown, instructions may reside, completely or at least partially, within the computer readable storage medium 1116, system memory 1106 and/or within the processor(s) 1130 during execution thereof by the user device 1105, the system memory 1106 and the processor(s) 1130 constituting computer-readable media. The user device 1105 may also include one or more input devices 1120 (keyboard, mouse device, specialized selection keys, etc.) and one or more output devices 1118 (displays, printers, audio output mechanisms, etc.).

The user device 1105 further includes a wireless modem 1122 to allow the user device 1105 to communicate via a wireless network (e.g., such as provided by a wireless communication system) with other computing devices, such as remote computers, an item providing system, and so forth. The wireless modem 1122 allows the user device 1105 to handle both voice and non-voice communications (such as communications for text messages, multimedia messages, media downloads, web browsing, etc.) with a wireless communication system. The wireless modem 1122 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1xRTT), evaluation data optimized (EVDO), high-speed downlink packet access (HSDPA), WiFi, etc. In other embodiments, the wireless modem 1122 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 1105 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 1105 to communicate with other devices, such as other user devices, server computing systems, telephone devices, or the like. In addition to wirelessly connecting to a wireless communication system, the user device 1105 may also wirelessly connect with other user devices. For example, user device 1105 may form a wireless ad hoc (peer-to-peer) network with another user device.

The wireless modem 1122 may generate signals and send these signals to power amplifier (amp) 1180 or power amp 1186 for amplification, after which they are wirelessly transmitted via the antenna 100 or antenna 1184, respectively. Although FIG. 11 illustrates power amps 1180 and 1186, in other embodiments, a transceiver may be used to all the antennas 100 and 1184 to transmit and receive. The antenna 1184, which is an optional antenna that is separate from the antenna 100, may be any directional, omnidirectional or non-directional antenna in a different frequency band than the frequency bands of the antenna 100. The antenna 1184 may also transmit information using different wireless communication protocols than the antenna 100. In addition to sending data, the antenna 100 and the antenna 1184 also receive data, which is sent to wireless modem 1122 and transferred to processor(s) 1130. It should be noted that, in other embodiments, the user device 1105 may include more or less components as illustrated in the block diagram of FIG. 11.

In one embodiment, the user device 1105 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the antenna 100 that operates at a first frequency band and the second wireless connection is associated with a second resonant mode of the antenna 100 that operates at a second frequency band. In another embodiment, the first wireless connection is associated with the antenna 100 and the second wireless connection is associated with the antenna 1184. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 1122 is shown to control transmission to both antennas 100 and 1184, the user device 1105 may alternatively include multiple wireless modems, each of which is configured to transmit/receive data via a different antenna and/or wireless transmission protocol. In addition, the user device 1105, while illustrated with two antennas 100 and 1184, may include more or fewer antennas in various embodiments.

The user device 1105 delivers and/or receives items, upgrades, and/or other information via the network. For example, the user device 1105 may download or receive items from an item providing system. The item providing system receives various requests, instructions and other data from the user device 1105 via the network. The item providing system may include one or more machines (e.g., one or more server computer systems, routers, gateways, etc.) that have processing and storage capabilities to provide the above functionality. Communication between the item providing system and the user device 1105 may be enabled via any communication infrastructure. One example of such an infrastructure includes a combination of a wide area network (WAN) and wireless infrastructure, which allows a user to use the user device 1105 to purchase items and consume items without being tethered to the item providing system via hardwired links. The wireless infrastructure may be provided by one or multiple wireless communications systems, such as one or more wireless communications systems. One of the wireless communication systems may be a wireless fidelity (WiFi) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 1105.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1105 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1105 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

Figure 12:
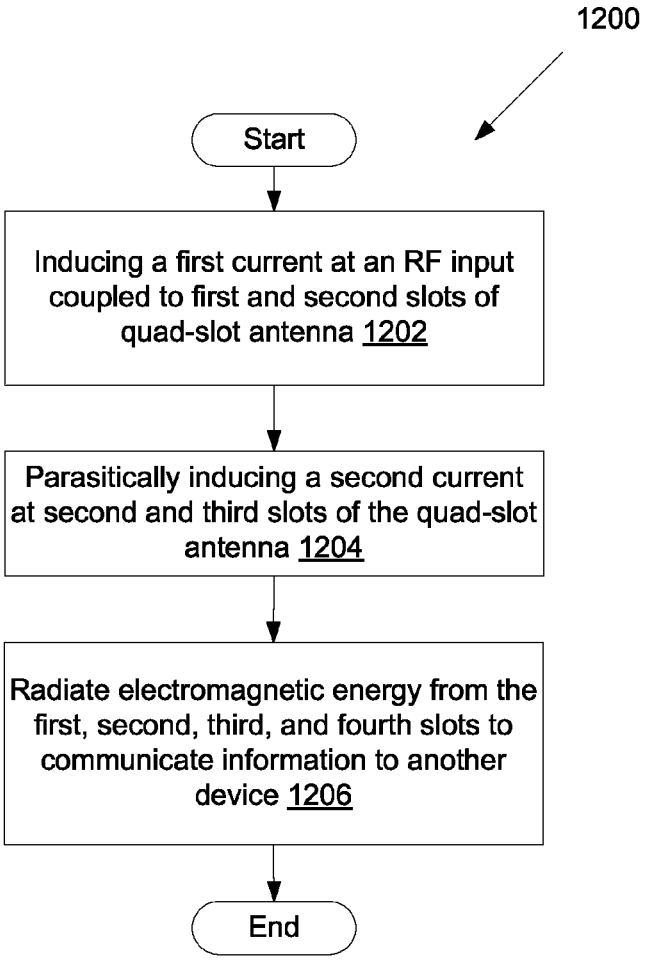
FIG. 12 is a flow diagram of an embodiment of a method of operating a user device having a quad-slot antenna according to one embodiment.

FIG. 12 is a flow diagram of an embodiment of a method 1200 of operating a user device having a quad-slot antenna structure 100 of FIG. 1 according to one embodiment. In method 1200, a first current is induced at a RF feed coupled to a quad-slot antenna (e.g., 100). The quad-slot antenna includes a first slot and a second slot conductively connected to the RF feed and a third slot and a fourth slot that are not conductively connected to the RF feed. In response, the first current parasitically induces a second current at the third slot and a third current at the fourth slot (block 1204). The first slot and the second slot operate as feeding structures to the third slot and the fourth slot. In response to the induced currents, electromagnetic energy is radiated from the first slot, second slot, third slot, and fourth slot to communicate information to another device (block 1206). The electromagnetic energy forms a radiation pattern. The radiation pattern may be various shapes as would be appreciated by one of ordinary skill in the art having the benefit of this disclosure.

In another embodiment, a current is induced at the RF feed, which induces a surface current flow around the first and second slots. The surface current flow then induces surface current flow around the third and fourth slots.

In a further embodiment, the method radiates electromagnetic energy by radiating the first slot as a first monopole open slot in a first resonant mode, radiating the second slot as a dipole closed slot in a second resonant mode, radiating the third slot as a hybrid open slot in a third resonant mode, and radiating the fourth slot as a second monopole open slot in a fourth resonant mode. In one embodiment, the hybrid open slot is radiated as a monopole open slot. In another embodiment, the hybrid open slot is radiated as an L-shape monopole.

In another embodiment, the first slot is radiated to cover a low band frequency range of 824 MHz to 960 MHz, and the second, third, and fourth slots are radiated to cover a high band frequency range of 1.71 GHz to 2.17 GHz. In another embodiment, the first slot and the third slot are radiated to cover a low band frequency range of 824 MHz to 960 MHz, and the second and fourth slots are radiated to cover a high band frequency range of 1.71 GHz to 2.17 GHz.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus.

Various general-purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. A user device, comprising:

a circuit board comprising a transceiver and a ground plane;

a radio frequency (RF) feed coupled to the transceiver; and a quad-slot antenna coupled to the RF feed and formed as slot openings in the ground plane, wherein the quad-slot antenna comprises:

a first monopole open slot;

a dipole closed slot;

an open slot; and a second monopole open slot, wherein the first monopole open slot and the dipole closed slot are driven elements and the open slot and the second monopole open slot are parasitic elements, wherein the open slot is a hybrid open slot configured to radiate electromagnetic energy as a monopole open slot in a first configuration and as an L-shape monopole in a second configuration.

2. The user device of claim 1, wherein the first monopole open slot is configured to radiate electromagnetic energy in a low band of a standard wireless frequency band, and wherein the dipole closed slot and the second monopole open slot are configured to radiate electromagnetic energy a high band of the standard wireless frequency band.

3. The user device of claim 2, wherein the open slot is configured to radiate electromagnetic energy in the high band of the standard wireless frequency band.

4. The user device of claim 2, wherein the open slot is configured to radiate electromagnetic energy in the low band of the standard wireless frequency band.

5. The user device of claim 2, wherein the standard wireless frequency band is the $3^{rd}$ Generation (3G) wireless standard, standardized by the 3rd Generation Partnership Project (3GPP).

6. An apparatus comprising:

a radio frequency (RF) feed; and a quad-slot antenna coupled to the RF feed, the quad-slot antenna formed as slot openings in a metallic member, wherein the quad-slot antenna comprises:

a first slot;

a second slot;

a third slot; and a fourth slot, wherein the first slot and the second slot are driven elements and the third slot and the fourth slot are parasitic elements, wherein the quad-slot antenna is configured to radiate electromagnetic energy as a monopole open slot in a first configuration and as an L-shape monopole in a second configuration.

7. The apparatus of claim 6, wherein the first slot is a first monopole open slot, the second slot is a dipole closed slot, the third slot is a hybrid open slot, and the fourth slot is an second monopole open slot.

8. The apparatus of claim 7, wherein the hybrid open slot comprise a first length in a first configuration to operate as a monopole open slot, and the hybrid open slot comprises a second length in a second configuration to operate as an L-shape monopole.

9. The apparatus of claim 7, wherein the first slot is configured to radiate electromagnetic energy in a low band of a wireless frequency band, and wherein the second, third, and fourth slots are configured to radiate electromagnetic energy a high band of the wireless frequency band.

10. The apparatus of claim 7, wherein the first slot and the third slot are configured to radiate electromagnetic energy in a low band of a wireless frequency band, and wherein the second and fourth slots are configured to radiate electromagnetic energy a high band of the wireless frequency band.

11. The apparatus of claim 6, wherein metallic member is at least one of a structural member that at least partially supports at least one of a display of a user device, a user input device of the user device, a circuit board of the user device, a metallic housing of the user device, a metal portion of a non-metallic housing of the user device, or a metallic bezel of the user device.

12. The apparatus of claim 6, wherein the first slot extends in a first direction from the RF feed towards a first side of the metallic member until a first bend and extends from the first bend to a second side of the metallic member to form a first open slot opening at the second side of the metallic member, wherein the second slot extends from the RF feed toward the second side until a second bend and extends from the second bend in the first direction substantially parallel to the first slot and stops to form a closed slot opening in the metallic member, wherein the third slot extends from a second slot opening at the second side of the metallic member towards the second slot until a third bend and extends from the third bend in the first direction substantially parallel to the second slot, and wherein the fourth slot extends from a third slot opening at the second side of the metallic member until a fourth bend and extends from the fourth bend towards the RF feed in the first direction until a fifth bend and extends from the fifth bend towards the second side of the metallic member.

13. The apparatus of claim 12, wherein an effective width of the quad-slot antenna is 84.5 millimeters (mm) and an effective height of the quad-slot antenna is 10.5 mm.

14. A method of operating a user device, the method comprising:

inducing a first current at a radio frequency (RF) feed coupled to a quad-mode antenna, wherein the quad-mode antenna comprises:

a first slot;

a second slot;

a third slot; and a fourth slot, wherein the first slot and the second slot are driven elements and the third slot and the fourth slot are parasitic elements;

in response, parasitically inducing a second current at the third slot and a third current at the fourth slot, wherein the first slot and the second slot operate as feeding structures to the third slot and the fourth slot; and radiating electromagnetic energy from the first slot, second slot, third slot, and fourth slot to communicate information to another device in response to the first current and the second current, wherein the radiating the electromagnetic energy comprises:

radiating the third slot as a monopole open slot in a first configuration; and radiating the third slot as an L-shape monopole in a second configuration.

15. The method of claim 14, wherein the radiating the electromagnetic energy comprises:

radiating the first slot as a first monopole open slot in a first resonant mode;

radiating the second slot as a dipole closed slot in a second resonant mode;

radiating the third slot in a third resonant mode; and radiating the fourth slot as a second monopole open slot in a fourth resonant mode.

16. The method of claim 14, wherein the radiating the electromagnetic energy comprises:

radiating the first slot to cover a low band frequency range of 824 MHz to 960 MHz; and radiating the second, third, and fourth slots to cover a high band frequency range of 1.71 GHz to 2.17 GHz.

17. The method of claim 14, wherein the radiating the electromagnetic energy comprises:

radiating the first slot and the third slot to cover a low band frequency range of 824 MHz to 960 MHz; and radiating the second and third slots to cover a high band frequency range of 1.71 GHz to 2.17 GHz.

* * * * *